US010168632B2

(12) United States Patent
Terada et al.

(10) Patent No.: US 10,168,632 B2
(45) Date of Patent: Jan. 1, 2019

(54) TONER FOR ELECTROSTATIC USE

(71) Applicant: Samsung Electronics Co., Ltd., Suwon-si (KR)

(72) Inventors: Akinori Terada, Yokohama (JP); Masahide Yamada, Yokohama (JP); Rie Sakurai, Yokohama (JP)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 15/856,641

(22) Filed: Dec. 28, 2017

(65) Prior Publication Data

US 2018/0181015 A1 Jun. 28, 2018

(30) Foreign Application Priority Data

Dec. 28, 2016 (JP) ..... 2016-255709

(51) Int. Cl.
*G03G 9/087* (2006.01)
*G03G 9/09* (2006.01)

(52) U.S. Cl.
CPC ..... *G03G 9/0906* (2013.01); *G03G 9/08755* (2013.01)

(58) Field of Classification Search
CPC ..... G03G 9/08755; G03G 9/08791; G03G 9/0908
See application file for complete search history.

(56) References Cited

U.S. PATENT DOCUMENTS 9,612,546 B2 4/2017 Hiroshi et al.
9,740,125 B2 8/2017 Yamada et al.

FOREIGN PATENT DOCUMENTS

| | | | | |
|---|---|---|---|---|
| JP | 6-3858 A | | 1/1994 | |
| JP | 9-197717 A | | 7/1997 | |
| JP | 2006-256130 A | | 9/2006 | |
| JP | 2007-140259 A | | 6/2007 | |
| JP | 2008-170866 A | | 7/2008 | |
| JP | 2009-217254 A | | 9/2009 | |
| JP | 2099-118260 A | | 6/2011 | |
| JP | 2011-158748 A | | 8/2011 | |
| JP | 2015-121727 | * | 7/2015 | ..... G03G 9/09 |
| JP | 2016-151700 A | | 8/2016 | |

OTHER PUBLICATIONS

Translation of JP 2015-121727.*

* cited by examiner

*Primary Examiner* — Peter L Vajda
(74) *Attorney, Agent, or Firm* — NSIP Law

(57) ABSTRACT

A toner for electrostatic use includes a binder resin including an amorphous polyester resin having a urethane bond and a crystalline polyester resin, a metal ion forming a chemical bond with the binder resin, at least one colorant forming a coordinate bond with the metal ion and being supported on the binder resin through the metal ion, and at least three elements selected from an iron element, a silicon element, a sulfur element, and a fluorine element while including at least one of an iron element, a silicon element, and a sulfur element, wherein an amount of the iron element is about 1000 ppm to about 10000 ppm as an element concentration, an amount of the silicon element is about 1000 ppm to about 5000 ppm as an element concentration, and an amount of the sulfur element is about 500 ppm to about 3000 ppm as an element concentration.

20 Claims, 2 Drawing Sheets

FIG. 2

| | Example 1 | Example 2 | Example 3 | Example 4 | Example 5 | Comparative Example 1 | Comparative Example 2 | Comparative Example 3 | Comparative Example 4 |
|---|---|---|---|---|---|---|---|---|---|
| Ratio of urethane group [mass%] | 1.3 | 1.3 | 1.3 | 0.8 | 0.8 | 1.3 | 1.3 | 2.5 | 0.4 |
| Amount of colorant [mass%] | 8.2 | 8.2 | 8.1 | 8.7 | 8.6 | 8.0 | 8.0 | 12.8 | 2.3 |
| Amount of metal ion [mass%] | 1.7 | 1.6 | 1.8 | 0.96 | 0.95 | 0.0 | 0.0 | 3.5 | 0.64 |
| Light transmittance [%] | 74.6 | 73.9 | 74.4 | 74.0 | 74.2 | 56.3 | 76.6 | 70.5 | 78.2 |
| a* | 76.1 | 75.3 | 76.3 | 74.2 | 75.7 | 74.0 | 75.1 | 72.6 | 76.3 |
| b* | -2.8 | -3.1 | -2.5 | -2.7 | -2.9 | -2.7 | -2.9 | -2.1 | -2.0 |
| L* | 57.2 | 56.8 | 57.0 | 56.7 | 56.9 | 56.6 | 56.8 | 51.3 | 59.7 |
| OD | 0.96 | 0.93 | 0.95 | 0.92 | 0.94 | 0.97 | 0.87 | 0.97 | 0.79 |
| MFT [°C] | 124 | 125 | 122 | 130 | 119 | 121 | 123 | 133 | 120 |
| Charge properties (high temperature and high humidity) | A | A | A | A | A | A | B | C | A |
| Charge properties (room temperature and normal humidity) | A | A | A | A | A | A | A | B | A |
| Charge properties (low temperature and low humidity) | A | A | A | A | A | A | B | C | A |
| High temperature preservation | A | A | A | A | A | A | B | C | A |
| Durable printability | A | A | A | A | A | A | B | C | A |
| Light resistance | A | A | A | A | A | A | D | D | D |

TONER FOR ELECTROSTATIC USE

CROSS-REFERENCE TO RELATED APPLICATIONS

This application claims the benefit under 35 USC 119(a) of Japanese Patent Application No. 2016-255709 filed on Dec. 28, 2016, in the Japan Patent Office, the entire disclosure of which is incorporated herein by reference for all purposes.

BACKGROUND

Field

This application discloses a toner for developing an electrostatic image.

Description of Related Art

Electrophotographic methods of visualizing an image using electrostatic images are currently used in various fields. In the electrophotographic methods, an electrostatic image is formed on a photoreceptor by a charging process and an exposure process, the electrostatic image on the photoreceptor is developed by a developer such as a toner, and an image is visualized by transferring the developed electrostatic image to a piece of paper, and fixing the transferred developed electrostatic image to the paper. A variety of dyes or pigments may be used as a colorant of the toner.

Recently, to obtain a high-resolution image, research has been conducted to develop a toner having a smaller particle diameter. However, as toner particles become smaller, a concentration of a colorant of the toner should increase to ensure stable image color concentration. However, when the colorant has a low light transmittance, light may be reflected or scattered by the colorant. Thus, as a concentration of the colorant increases, a chroma may deteriorate, and a color reproducibility range may be limited.

SUMMARY

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter.

In one general aspect, a toner for electrostatic use includes a binder resin including an amorphous polyester resin having a urethane bond and a crystalline polyester resin; a metal ion forming a chemical bond with the binder resin; at least one colorant forming a coordinate bond with the metal ion and being supported on the binder resin through the metal ion; and at least three elements selected from an iron element, a silicon element, a sulfur element, and a fluorine element while including at least one of an iron element, a silicon element, and a sulfur element; wherein an amount of the iron element is about 1000 ppm to about 10000 ppm as an element concentration; an amount of the silicon element is about 1000 ppm to about 5000 ppm as an element concentration; and an amount of the sulfur element is about 500 ppm to about 3000 ppm as an element concentration.

The at least three elements may include a fluorine element; and an amount of the fluorine element may be about 1000 ppm to about 10000 ppm as an element concentration.

The metal ion may be an ion of a metal selected from magnesium, aluminum, iron, cobalt, nickel, copper, and zinc.

The colorant may include a compound having a maximum absorption wavelength in a wavelength range of about 500 nm to about 600 nm and represented by the following Chemical Formula 1:

(Chemical Formula 1)

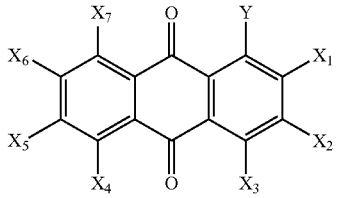

wherein, in Chemical Formula 1, Y is one of a hydroxy group, a primary amino group represented by $NHR_1$, and a secondary amino group represented by $NHR_1R_2$, $R_1$ and $R_2$ are independently a C1 to C20 linear group, a C1 to C20 branched alkyl group, or a C6 to C20 aryl group, and $X_1$ to $X_7$ are independently hydrogen, a halogen, an amino group, a nitro group, a hydroxy group, an alkoxy group, a C1 to C20 linear group, a C1 to C20 branched alkyl group, or a C6 to C20 aryl group; and the compound represented by the Chemical Formula 1 may include either one or both of a nitrogen atom and an oxygen atom of the Chemical Formula 1 that forms a coordinate bond with the metal ion.

The compound represented by the Chemical Formula 1 may be an organic dye; and a light transmittance of the toner for electrostatic use at a wavelength of 650 nm may be about 70% to about 100%.

The metal ion may form a coordinate bond with the urethane bond of the amorphous polyester resin.

A ratio of the urethane bond forming a coordinate bond with the metal ion may be about 80% to about 100%.

The metal ion may form a coordinate bond with the urethane bond of the amorphous polyester resin in a ratio of about 1:1 to about 1:2.

The metal ion may form a coordinate bond with the at least one colorant in a ratio of about 1:1 to about 1:2.

A ratio of the urethane bond may be about 0.5 mass % to about 2.0 mass % based on a total mass of the toner for electrostatic use.

An amount of the metal ion may be about 0.7 mass % to about 2.5 mass % based on a total mass of the toner for electrostatic use.

In another general aspect, a toner for electrostatic use includes a binder resin including an amorphous polyester resin having a urethane bond and a crystalline polyester resin; a metal ion forming a chemical bond with the binder resin; and a colorant forming a chelate bond with the metal ion and being supported on the binder resin through the metal ion.

The chelate bond may include two or more coordinate bonds.

The colorant may include a compound including a carbonyl group including an oxygen atom; and a functional group including one or more oxygen atoms, or one or more nitrogen atoms, or one or more oxygen atoms and one or more nitrogen atoms; wherein the colorant forms the chelate bond with at least two atoms selected from the oxygen atom of the carbonyl group, the one or more oxygen atoms, if any, of the functional group, and the one or more nitrogen atoms, if any, of the functional group.

The compound may represented by the following Chemical Formula 1:

(Chemical Formula 1)

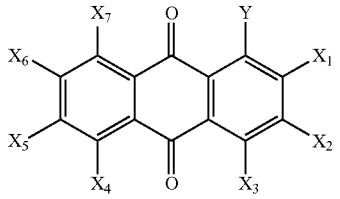

wherein, in Chemical Formula 1, O is the oxygen atom of the carbonyl group, Y is the functional group and is one of a hydroxy group, a primary amino group represented by $NHR_1$, and a secondary amino group represented by $NHR_1R_2$, $R_1$ and $R_2$ are independently a C1 to C20 linear group, a C1 to C20 branched alkyl group, or a C6 to C20 aryl group, and $X_1$ to $X_7$ are independently hydrogen, a halogen, an amino group, a nitro group, a hydroxy group, an alkoxy group, a C1 to C20 linear group, a C1 to C20 branched alkyl group, or a C6 to C20 aryl group.

The compound represented by the Chemical Formula 1 may have a maximum absorption wavelength in a wavelength range of about 500 nm to about 600 nm.

The compound represented by the Chemical Formula 1 may be an organic dye.

A light transmittance of the toner for electrostatic use at a wavelength of 650 nm may be about 70% to about 100%.

The toner for electrostatic use may further include at least three elements selected from an iron element, a silicon element, a sulfur element, and a fluorine element while including at least one of an iron element, a silicon element, and a sulfur element; wherein an amount of the iron element is about 1000 ppm to about 10000 ppm as an element concentration; an amount of the silicon element is about 1000 ppm to about 5000 ppm as an element concentration; and an amount of the sulfur element is about 500 ppm to about 3000 ppm as an element concentration.

The at least three elements may include a fluorine element; and an amount of the fluorine element may be about 1000 ppm to about 10000 ppm as an element concentration.

Other features and aspects will be apparent from the following detailed description and the claims.

BRIEF DESCRIPTION OF THE DRAWING

FIG. 2 is a table showing evaluation results of the toners for electrostatic use according to Examples 1 to 5 and Comparative Examples 1 to 4.

Throughout the drawings and the detailed description, the same reference numerals refer to the same elements. The drawings may not be to scale, and the relative size, proportions, and depiction of elements in the drawings may be exaggerated for clarity, illustration, and convenience.

DETAILED DESCRIPTION

Figure 1:
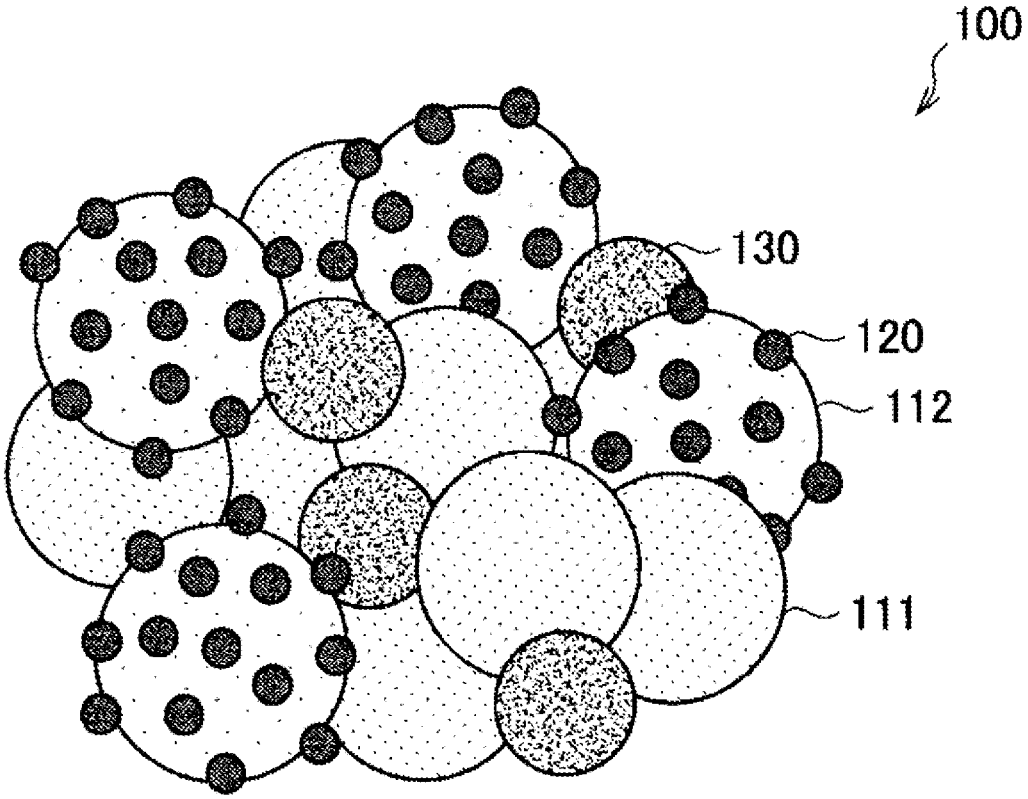
FIG. 1 illustrates an example of a structure of a toner for electrostatic use.

The following detailed description is provided to assist the reader in gaining a comprehensive understanding of the methods, apparatuses, and/or systems described herein. However, various changes, modifications, and equivalents of the methods, apparatuses, and/or systems described herein will be apparent after an understanding of the disclosure of this application. For example, the sequences of operations described herein are merely examples, and are not limited to those set forth herein, but may be changed as will be apparent after an understanding of the disclosure of this application, with the exception of operations necessarily occurring in a certain order. Also, descriptions of features that are known in the art may be omitted for increased clarity and conciseness.

The features described herein may be embodied in different forms, and are not to be construed as being limited to the examples described herein. Rather, the examples described herein have been provided merely to illustrate some of the many possible ways of implementing the methods, apparatuses, and/or systems described herein that will be apparent after an understanding of the disclosure of this application.

<1. Structure of Toner>

FIG. 1 illustrates an example of a structure of a toner for electrostatic use.

A toner 100 for electrostatic use includes a crystalline polyester resin 111 and an amorphous polyester resin 112 constituting a binder resin, a colorant 120, and wax 130 as shown in FIG. 1.

The toner 100 for electrostatic use includes at least one colorant 120 forming a coordinate bond with a metal ion on a surface of the amorphous polyester resin 112 of the binder resin. Accordingly, the toner 100 for electrostatic use includes at least one colorant 120 forming a tight bond with the surface of the amorphous polyester resin 112. As a result, the toner 100 for electrostatic use has an improved light resistance even if the colorant 120 has a high light transmittance.

Hereinafter, each component of the toner 100 for electrostatic use is described in detail.

(Binder Resin)

The binder resin is an important primary particle of an agglomeration particle of the toner 100 for electrostatic use. The agglomeration particle includes a plurality of the primary particles, and will be described later. An example of a binder resin includes at least the amorphous polyester resin 112 and the crystalline polyester resin 111. An amount of the binder resin may be, for example, about 80 mass % to about 95 mass % of a total mass of the toner 100 for electrostatic use.

The amorphous polyester resin 112 is synthesized by performing a dehydration condensation of a polycarboxylic acid component and a polyol component, and performing urethane-modification of a resin obtained by the dehydration condensation using a polyisocyanate component. That is, the amorphous polyester resin 112 has a chemical structure including a urethane bond.

In addition, at least one colorant 120 is supported on a particle surface of the amorphous polyester resin 112 through a metal ion. Specifically, the urethane bond of the amorphous polyester resin 112 forms a coordinate bond with the metal ion, and the colorant 120 forms a coordinate bond with the metal ion and thereby forms a chemical bond with the amorphous polyester resin 112 through the metal ion. The details of the metal ion and the colorant 120 are described later.

A ratio of the urethane bond of the amorphous polyester resin 112 may be about 0.5 mass % to about 2.0 mass %, for example, about 0.8 mass % to about 1.5 mass %, of a total mass of the toner 100 for electrostatic use. When the ratio of the urethane bond is within these ranges, an amount of the colorant 120 sufficient to realize a wide color reproducibility area is supported on the amorphous polyester resin 112.

When the ratio of the urethane bond is less than about 0.5 mass %, the color reproducibility area of the toner 100 for electrostatic use is reduced, while when the ratio of the urethane bond is greater than about 2.0 mass %, a light transmittance of the toner 100 for electrostatic use is decreased and displayable colors are deteriorated.

The ratio of the urethane bond of the amorphous polyester resin 112 may be calculated by using, for example, a method of calculating a peak area corresponding to a urethane bond in a C13-NMR (Nuclear Magnetic Resonance) spectrum. In addition, the ratio of the urethane bond of the amorphous polyester resin 112 may be controlled by adjusting kinds and a combination ratio of the polycarboxylic acid component and the polyol component used for synthesis of the amorphous polyester resin 112, and a kind and an amount of the polyisocyanate component used to perform the urethane modification.

In one example, a ratio of the urethane bond of the amorphous polyester resin 112 forming a coordinate bond with the metal ion may be, for example, about 80% to about 100%, for example, about 90% to about 100%. When the ratio of the urethane bond forming a coordinate bond with the metal ion is within these ranges, an amount of the colorant 120 sufficient to realize a wide color reproducibility area is supported on the amorphous polyester resin 112.

When the ratio of the urethane bond forming a coordinate bond with the metal ion is less than about 80%, a color reproducibility area of the toner 100 for electrostatic use is reduced.

The ratio of the urethane bond forming a coordinate bond with the metal ion may be obtained, for example, by measuring an absorbance of the amorphous polyester resin 112 on which the colorant 120 is supported and calculating a molar extinction coefficient caused by a urethane bond forming a coordinate bond with the metal ion. The ratio of the urethane bond forming a coordinate bond with the metal ion may be controlled by adjusting kinds and amounts of the metal ions used during a reaction between the amorphous polyester resin 112 and the colorant 120.

The polycarboxylic acid component used for synthesis of the amorphous polyester resin 112 is not particularly limited, but may be, for example, an organic polycarboxylic acid such as maleic anhydride, phthalic anhydride, or succinic acid. The polyol component used for synthesis of the amorphous polyester resin 112 is not particularly limited, but may be, for example, a propylene oxide 2 mol addition product of bisphenol A or an ethylene oxide 2 mol addition product of bisphenol A. The polyisocyanate component used for urethane modification of the amorphous polyester resin 112 is not particularly limited, but may be, for example, any general polyisocyanate compound such as diphenylmethane diisocyanate, toluene diisocyanate, isophorone diisocyanate, hexamethylene diisocyanate, and norbornene diisocyanate, but is not limited thereto.

The crystalline polyester resin 111 is synthesized by performing a dehydration condensation of a polycarboxylic acid component and a polyol component.

The polycarboxylic acid component used for synthesis of the crystalline polyester resin 111 is not particularly limited, but may be, for example, an aliphatic polycarboxylic acid such as adipic acid, sebacic acid, or dodecane 2 acid. The polyol component used for synthesis of the crystalline polyester resin 111 is not particularly limited, but may, be for example, an aliphatic polyol such as 1,6-hexanediol, 1,8-octanediol, 1,9-nonanediol, or 1,10-decanediol.

An amount of the amorphous polyester resin 112 may be about 80 mass % to about 95 mass % of a total mass of the binder resin, and an amount of the crystalline polyester resin 111 may be about 5 mass % to about 20 mass % of a total mass of the binder resin. When the amount of the crystalline polyester resin 111 is less than about 5 mass %, fixation of the toner 100 for electrostatic use is deteriorated, while when the amount of the crystalline polyester resin 111 is greater than about 20 mass %, a durability and charging characteristics of the toner 100 for electrostatic use are deteriorated.

(Colorant)

The colorant 120 may be a dye or a pigment that determines a color of the toner 100 for electrostatic use, and in one example, at least one colorant 120 is supported on a surface of the amorphous polyester resin 112 through a metal ion. The colorant 120 supported on the surface of the amorphous polyester resin 112 specifically forms a coordinate bond with a metal ion and is a compound having an absorption maximum wavelength in a wavelength range of about 500 nm to about 600 nm.

For example, the colorant 120 may include an organic dye. Because the organic dye has a high light transmittance, the toner 100 for electrostatic use increases a light transmittance in a wavelength of 650 nm to about 70% to about 100% by using the organic dye as the colorant 120. In this case, a light transmittance is improved, displayable colors of the toner 100 for electrostatic use are improved, and thus a color reproducibility area is enlarged. A light transmittance of the colorant 120 and the toner 100 for electrostatic use may be measured by using, for example, a spectrophotometer.

For example, the colorant 120 may be represented by Chemical Formula 1 below and may be a compound having an absorption maximum wavelength in a wavelength range of about 500 nm to about 600 nm.

(Chemical Formula 1)

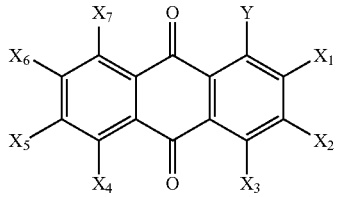

In Chemical Formula 1, Y is one of a hydroxy group, a primary amino group represented by $NHR_1$, and a secondary amino group represented by $NHR_1R_2$, where $R_1$ and $R_2$ are independently a C1 to C20 linear alkyl group, a C1 to C20 branched alkyl group, or a C6 to C20 aryl group, and $X_1$ to $X_7$ are independently hydrogen, a halogen, an amino group, a nitro group, a hydroxy group, an alkoxy group, a C1 to C20 linear alkyl group, a C1 to C20 branched alkyl group, or a C6 to C20 aryl group. $R_1$ and $R_2$ may be the same as each other or different from each other.

The compound represented by Chemical Formula 1 may include, for example, at least one oxygen atom and/or nitrogen atom inside the functional group represented by Y and an oxygen atom of a carbonyl group (=O) in Chemical Formula 1 that form a coordinate bond with a metal ion. For example, two or more oxygen atoms and/or nitrogen atoms inside the functional group represented by Y and the oxygen atom of the carbonyl group (=O) in Chemical Formula 1 may form a chelate bond with the metal ion. Accordingly, the compound represented by Chemical Formula 1 may form two or more coordinate bonds between two or more oxygen atoms and/or nitrogen atoms of Chemical Formula 1 and the metal ion, and thus may be tightly bound to the metal ion compared with amorphous polyester resin 112.

The C1 to C20 linear alkyl group or the C1 to C20 branched alkyl group may be, for example, a methyl group, an ethyl group, a propyl group, an isopropyl group, a n-butyl group, a s-butyl group, an isobutyl group, a t-butyl group, a n-pentyl group, a n-hexyl group, a n-heptyl group, or a n-octyl group, but are not limited thereto. The C6 to C20 aryl group may be, for example, a phenyl group, a naphthyl group, an anthryl group, a phenanthryl group, a naphthacenyl group, a pyrenyl group, a biphenylyl group, a terphenyl group, a tolyl group, a fluoranthenyl group, or a fluorenyl group, but is not limited thereto. The alkoxy group may be, for example, a monovalent functional group where the C1 to C20 linear alkyl group, the C1 to C20 branched alkyl group, or the C6 to C20 aryl group is bound through an oxygen atom.

Examples of the compound represented by Chemical Formula 1 and usable as the colorant 120 are 1-(methylamino)anthraquinone, 1-amino-4-hydroxyanthraquinone, 1-hydroxyanthraquinone, and 1,4-diaminoanthraquinone, but are not limited thereto.

The colorant 120 may further include a known inorganic pigment or organic pigment in addition to the organic dye as a colorant of the toner 100 for electrostatic use.

An amount of the colorant 120 may be about 5 mass % to about 10 mass % of a total mass of the toner 100 for electrostatic use. When the amount of the colorant 120 is within this range, the toner 100 for electrostatic use has a wide color reproducibility area. When the amount of the colorant 120 is less than about 5 mass %, a color reproducibility area of the toner 100 for electrostatic use is reduced, while when the amount of the colorant 120 is greater than about 10 mass %, a light transmittance of the toner 100 for electrostatic use is deteriorated, and thus displayable colors are deteriorated.

In one example, the metal ion forms coordinate bonds with the amorphous polyester resin 112 and the at least one colorant 120. Specifically, the metal ion is an ion of a metal (a typical metal or a transition metal) that is capable of forming a complex, and may be, for example, an ion of at least one metal selected from magnesium, aluminum, iron, cobalt, nickel, copper, and zinc.

In one example, the metal ion forms a coordinate bond with the urethane bond of the amorphous polyester resin 112 in a ratio of about 1:1 to about 1:2. That is, one metal ion forms a coordinate bond with one to two urethane bonds.

When the metal ion forms a chelate bond with two or more urethane bonds, the amorphous polyester resin 112 and the colorant 120 may tightly form a chemical bond through the metal ion. A coordinate bond ratio between the urethane bond of the amorphous polyester resin 112 and the metal ion may be controlled by adjusting, for example, a mixing ratio of the metal ion and the amorphous polyester resin 112.

The metal ion may form a coordinate bond with the at least one colorant 120 in a ratio of about 1:1 to about 1:2. That is, one metal ion may form a coordinate bond with one or two colorants 120.

When the metal ion forms a chelate bond with two or more colorants 120, the amorphous polyester resin 112 and the colorant 120 may tightly form a chemical bond through the metal ion. A coordinate bond ratio between the metal ion and the colorant 120 may be controlled by adjusting, for example, a mixing ratio of the metal ion and the colorant 120.

An amount of the metal ion may be about 0.7 mass % to about 2.5 mass %, for example, about 0.8 mass % to about 2.0 mass %, of a total mass of the toner 100 for electrostatic use. When the amount of the metal ion is within these ranges, the amorphous polyester resin 112 and the at least one colorant 120 are tightly bound, and thus a light resistance of the toner 100 for electrostatic use is improved. When the amount of the metal ion is less than about 0.7 mass %, a light resistance of the toner 100 for electrostatic use is deteriorated, while when the amount of the metal ion is greater than about 2.5 mass %, the improvement of a light resistance of the toner 100 for electrostatic use is saturated and/or oversaturated, and thus it is not desirable in terms of a manufacturing cost.

(Wax)

The wax 130 improves releasing properties and transfer performance of the toner 100 for electrostatic use and fixes the toner 100 for electrostatic use on a piece of paper. The wax 130 is agglomerated with the binder resin in the toner 100 for electrostatic use. For example, an amount of the wax 130 may be about 1 mass % to about 20 mass % of a total mass of the toner 100 for electrostatic use.

In one example, the wax 130 may be any known wax. For example, the wax 130 may be solid paraffin wax, micro wax, rice wax, fatty acid amide-based wax, fatty acid-based wax, aliphatic mono ketones, fatty acid metal salt-based wax, fatty acid ester-based wax, partially saponified fatty acid ester-based wax, silicon varnish, higher alcohols, carnauba wax, or a mixture of two or more waxes, each of which may be any known wax. In addition, the wax 130 may include polyolefins, such as low molecular weight polyethylene and polypropylene, but is not limited thereto.

The toner 100 for electrostatic use may further include a coating layer that coats a surface of an agglomeration particle of the toner 100 for electrostatic use. The coating layer may be formed of an amorphous polyester resin or a crystalline polyester resin that are the same as the binder resin.

In addition, to obtain stable charging characteristics, the toner 100 for electrostatic use may further include a metal complex, a quaternary ammonium salt, or a compound having a functional group such as a sulfonic acid group or a carboxyl group as a charge control agent.

The toner 100 for electrostatic use may include at least three elements selected from an iron element, a silicon element, a sulfur element, and a fluorine element while including at least one of an iron element, a silicon element, and a sulfur element.

An amount of the iron element may be about 1000 ppm to about 10000 ppm, for example, about 1000 ppm to about 5000 ppm, as an element concentration. An amount of the silicon element may be about 1000 ppm to about 5000 ppm, for example, about 1500 ppm to about 4000 ppm, as an element concentration. An amount of the sulfur element may be about 500 ppm to about 3000 ppm, for example, about 1000 ppm to about 3000 ppm, as an element concentration.

When the toner 100 for electrostatic use further includes a fluorine element, an amount of the fluorine element may be about 1000 ppm to about 10000 ppm, for example, about 5000 ppm to about 8000 ppm, as an element concentration.

The iron element and the silicon element contribute to agglomeration of the binder resin and the wax. The sulfur element also contributes to agglomeration of the binder resin and the wax, and may be a dehydration condensation catalyst of the amorphous or crystalline polyester resin. The fluorine element may be a dehydration condensation catalyst of the amorphous or crystalline polyester resin.

The elements are impurities resulting from a manufacturing process of the toner 100 for electrostatic use, and may be included in the toner 100 for electrostatic use in trace amounts that have an effect on properties of the toner 100 for electrostatic use.

For example, when the amounts of the iron element and the silicon element are above the ranges specified above, properties of the toner 100 for electrostatic use are excessively increased, while when the amounts of the iron element and the silicon element are under the ranges specified above, a structure of the toner 100 for electrostatic use is not formed sufficiently.

In addition, when the amount of the sulfur element is above the range specified above, electrical characteristics of the toner 100 for electrostatic use are deteriorated, while when the amount of the sulfur element is under the range specified above, a structure of the toner 100 for electrostatic use is not formed sufficiently.

In addition, when the amount of the fluorine element is above the range specified above, electrical characteristics of the toner 100 for electrostatic use are deteriorated, while when the amount of the fluorine element is under the range specified above, properties of the toner 100 for electrostatic use are deteriorated.

The amounts of the elements may be controlled by adjusting kinds and amounts of catalysts and agglomerating agents used in a manufacturing process of the toner 100 for electrostatic use. The amounts of the elements may be measured using, for example, an X-ray fluorescence spectrophotometer.

Recently, a need has developed for a colorant included in a toner to have a high concentration to ensure stable image color concentration as a toner particle becomes smaller. An organic dye absorbing light in a particular wavelength and transmitting light in other wavelengths has been disclosed as such a colorant for a toner. Because the organic dye does not reflect or scatter light, a color reproducibility area is not reduced when a colorant is included in a toner at a high concentration. However, since the toner including the organic dye has a high light transmittance, a light resistance of the colorant is low, and discoloration may occur.

However, the toner 100 for electrostatic use described in this application tightly supports at least one colorant 120 on a particle surface of the binder resin using a chemical bond. Accordingly, the toner 100 for electrostatic use described in this application improves a stability and a light resistance of the colorant 120.

Therefore, the toner 100 for electrostatic use having an improved stability and an improved light resistance of the colorant 120 disclosed in this application uses a compound (e.g., an organic dye) having a relatively high light transmittance as the colorant 120 and widens a color reproducibility area of the toner 100 for electrostatic use.

<3. Method of Manufacturing Toner>

Hereinafter, an example of a method of manufacturing the toner 100 for electrostatic use is described.

A method of manufacturing the toner 100 for electrostatic use includes a synthesis process of the amorphous polyester resin 112, a supporting process of the colorant 120, a forming process of amorphous polyester resin 112 latex, a synthesis process of the crystalline polyester resin 111, a forming process of crystalline polyester resin 111 latex, a forming process of a mixed solution, a forming process of an agglomeration particle, and a fusion process. By performing the processes sequentially, the toner 100 for electrostatic use may be manufactured.

(Synthesis Process of Amorphous Polyester Resin)

First, dehydration condensation of a polycarboxylic acid component and a polyol component is performed at a temperature of less than or equal to about 150° C. in the presence of a catalyst to synthesize a polyester resin. Next, urethane modification of the obtained polyester resin is performed with a polyisocyanate component to synthesize the amorphous polyester resin 112.

Specifically, first the polycarboxylic acid component, the polyol component, and a catalyst are added to a reaction vessel. The polycarboxylic acid component and the polyol component may be any of the compounds that are described above.

A catalyst used in synthesis of the amorphous polyester resin 112 may be a compound including at least a sulfur element of a sulfur element and a fluorine element. Examples of the catalyst may be strong acid compounds such as paratoluene sulfonic acid 1 hydrate, bis(1,1,2,2,3,3,4,4,4-nonafluoro-1-butanesulfonyl)imide, and scandium(III) triflate, but are not limited thereto.

The amounts of the polycarboxylic acid component and the polyol component may be appropriately determined considering characteristics of the amorphous polyester resin 112. In addition, an amount of the catalyst to control the amounts of the sulfur element and the fluorine element in the toner 100 for electrostatic use may, for example, range from about 0.1 mass % to about 2.0 mass % of a total amount of the mixture.

Subsequently, a temperature of a mixed solution of the polycarboxylic acid component, the polyol component, and the catalyst is increased to a predetermined temperature of less than or equal to about 150° C., the pressure inside the reaction vessel is reduced to a vacuum, and dehydration condensation of the polycarboxylic acid component and the polyol component is performed to synthesize a polyester resin. A synthesis condition of the polyester resin may be appropriately determined considering characteristics of the amorphous polyester resin 112.

Next, the pressure inside the reaction vessel is returned to a normal pressure and the polyisocyanate component and the organic solvent are added to the solution of the synthesized polyester resin. The polyisocyanate component may be, for example, any of the compound that are described above. An addition amount of the polyisocyanate component may be appropriately determined considering characteristics of the amorphous polyester resin 112.

Next, the inside the reaction vessel is filled with an inert gas atmosphere, and urethane modification of the polyester resin with the polyisocyanate component is performed at a predetermined temperature for a predetermined time to synthesize the amorphous polyester resin 112. A reaction condition of the urethane modification may be appropriately determined considering characteristics of the amorphous polyester resin 112.

(Supporting Process of Colorant)

In a supporting process of a colorant, the colorant 120 is supported on a particle surface of the amorphous polyester resin 112. A colorant 120 such as an inorganic pigment or an organic pigment may be added.

Specifically, the colorant 120 is dissolved in a solvent, and a solution including the colorant 120 is dripped into a solution including a metal ion to form a precursor complex in which the colorant 120 and the metal ion form a coordinate bond.

Then, the amorphous polyester resin 112 is added to a solution including the precursor complex to form a coordinate bond of the precursor complex on the particle surface of the amorphous polyester resin 112. Accordingly, the colorant 120 is fixed on the particle surface of the amorphous polyester resin 112 through the metal ion. Then, a solvent is removed by distillation to obtain the amorphous polyester resin 112 on which the colorant 120 is supported through the metal ion.

The solution including the metal ion may be a solution of any compound as long as it includes the metal ion. The ratios of the colorant 120, the solution including the metal ion, and the amorphous polyester resin 112 may be appropriately determined as long as the ratios of the coordinate bonds satisfy the ratios described above.

(Forming Process of Amorphous Polyester Resin Latex)

In a forming process of the amorphous polyester resin 112 latex, the amorphous polyester resin 112 on which the colorant 120 is supported is dissolved in an organic solvent. Next, a basic solution is slowly added while the solution including the amorphous polyester resin 112 is stirred, and water is added to form the amorphous polyester resin 112 latex.

Specifically, the amorphous polyester resin 112 on which the colorant 120 is supported and an organic solvent are added to a reaction vessel to dissolve the amorphous polyester resin 112 in the organic solvent. Examples of the organic solvent may be methyl ethyl ketone, isopropyl alcohol, ethyl acetate, or a mixture thereof, but are not limited thereto.

Next, a solution including the amorphous polyester resin 112 is slowly stirred, a basic solution is slowly added to the solution, and water is added at a predetermined speed to form a latex. Subsequently, the organic solvent is removed with the latex until the solid amorphous polyester resin 112 reaches a predetermined concentration.

Examples of the basic solution may be an ammonia solution and an amine compound aqueous solution, but are not limited thereto. An addition amount of water may be appropriately determined considering a particle diameter of the obtained latex, and an addition speed of water may be appropriately determined considering a particle diameter distribution.

(Synthesis Process of Crystalline Polyester Resin)

In a synthesis process of the crystalline polyester resin 111, a dehydration condensation of the polycarboxylic acid component and the polyol component is performed at about 100° C. or less in the presence of a catalyst to synthesize the crystalline polyester resin 111.

Specifically, the polycarboxylic acid component, the polyol component, and the catalyst are added to a reaction vessel. The polycarboxylic acid component and the polyol component may be any of the compounds described above.

The catalyst used for synthesis of the crystalline polyester resin 111 may be a compound including at least a sulfur element among a sulfur element and a fluorine element. Examples of the catalyst may be strong acid compounds such as paratoluene sulfonic acid 1 hydrate, bis(1,1,2,2,3,3,4,4,4-nonafluoro-1-butanesulfonyl)imide, or scandium(III) triflate.

Amounts of the polycarboxylic acid component and the polyol component may be appropriately determined considering characteristics of the amorphous polyester resin 112. An amount of the catalyst to control amounts of the sulfur element and the fluorine element within the ranges in the toner 100 for electrostatic use may be, for example, about 0.1 mass % to about 2.0 mass % of a total amount of the mixture.

Subsequently, a temperature of a mixed solution of the polycarboxylic acid component, the polyol component, and the catalyst is increased to a predetermined temperature of less than or equal to about 100° C., the pressure inside the reaction vessel is reduced to a vacuum, and dehydration condensation of the polycarboxylic acid component and the polyol component is performed to synthesize the crystalline polyester resin 111. The synthesis condition of the crystalline polyester resin 111 may be appropriately determined considering characteristics of the crystalline polyester resin.

(Forming Process of Crystalline Polyester Resin Latex)

In a forming process of the crystalline polyester resin 111 latex, first, the crystalline polyester resin 111 is dissolved in an organic solvent, a basic solution is slowly added while the solution including the crystalline polyester resin 111 is stirred, and water is added to form the crystalline polyester resin 111 latex.

Specifically, the crystalline polyester resin 111 and an organic solvent are added to a reaction vessel to dissolve the crystalline polyester resin 111 in the organic solvent. Examples of the organic solvent may be methyl ethyl ketone, isopropyl alcohol, ethyl acetate, or a mixture thereof, but are not limited thereto.

Next, a solution including the crystalline polyester resin 111 is slowly stirred, a basic solution is slowly added to the solution, and water is added at a predetermined speed to form a latex. Subsequently, the organic solvent is removed with the latex until the solid crystalline polyester resin 111 reaches a predetermined concentration.

Examples of the basic solution may be an ammonia solution and an amine compound aqueous solution, but are not limited thereto. In addition, an addition amount of water may be appropriately determined considering a particle diameter of the obtained latex, and an addition speed of water may be appropriately determined considering a particle diameter distribution.

(Forming Process of Mixed Solution)

In a forming process of the mixed solution, the amorphous polyester resin 112 latex, the crystalline polyester resin 111 latex, and a wax 130 dispersion liquid are mixed to form a toner mixed solution.

Specifically, the wax 130, an anionic surfactant, and water are mixed and dispersed to form a wax 130 dispersion liquid. The wax 130 may be the any of the compounds described above, and the anionic surfactant may be, for example, alkylbenzene sulfonic acid, but is not limited thereto. The dispersion may be performed, for example, using a homogenizer. The amounts of the wax 130, the anionic surfactant, and the water may be appropriately determined considering a dispersion state of the wax 130 in the wax 130 dispersion liquid.

Subsequently, the amorphous polyester resin 112 latex, the crystalline polyester resin 111 latex, and water are added to a reaction vessel. The wax 130 dispersion liquid is added to the reaction vessel while stirring a mixed solution of the amorphous polyester resin 112 latex, the crystalline polyester resin 111 latex, and the water, thereby forming a toner mixed solution.

The amounts of the amorphous polyester resin 112 latex, the crystalline polyester resin 111 latex, and the wax 130 dispersion liquid may be appropriately determined considering properties of the toner 100 for electrostatic use.

(Forming Process of Agglomeration Particle)

In a forming process of an agglomeration particle, an agglomerating agent is added to the toner mixed solution to agglomerate the amorphous polyester resin 112, the crystalline polyester resin 111, and the wax 130 with one another to form an agglomeration particle.

Specifically, first, the agglomerating agent and an acidic solution are added to the toner mixed solution while the toner mixed solution is stirred. Next, the toner mixed solution is dispersed and its temperature is increased at a predetermined speed, thereby forming an agglomeration particle in which the amorphous polyester resin 112, the crystalline polyester resin 111, and the wax 130 are agglomerated.

Examples of the acidic solution to promote an agglomeration reaction are a nitric acid solution and a hydrochloric acid solution, but are not limited thereto. The dispersion may be performed using, for example, a homogenizer.

The reaction conditions (the dispersion condition and the temperature increasing condition) during the agglomeration may be appropriately determined considering a particle diameter and a particle diameter distribution of the toner 100 for electrostatic use.

Examples of the agglomerating agent may be a compound including an iron element and a silicon element. For example, the agglomerating agent may be an iron-based metal salt such as polysilicate iron. In the toner 100 for electrostatic use, an amount of the agglomerating agent to satisfy the amount ranges of the iron element and the silicon element may be, for example, about 0.15 mass % to about 1.5 mass % of a total amount of the mixture.

In the toner 100 for electrostatic use, a coating layer may be further formed on a surface of the agglomeration particle. For example, the coating layer may be formed of some of the amorphous polyester resin 112 on which the colorant 120 is not supported.

Specifically, first, the amorphous polyester resin 112 latex is added to a dispersion liquid including the agglomeration particle, and the agglomeration particle and the amorphous polyester resin 112 are agglomerated with each other for a predetermined time. Next, a basic solution is added to the dispersion liquid including the agglomeration particle to change the pH, thereby stopping the agglomeration.

Accordingly, a coating layer including some of the amorphous polyester resin 112 is formed on a surface of the agglomeration particle. Examples of the basic solution to stop the agglomeration include a sodium hydroxide aqueous solution and a potassium hydroxide aqueous solution, but are not limited thereto.

(Fusion Process)

In a fusion process, the agglomeration particle is heated to fuse the amorphous polyester resin 112, the crystalline polyester resin 111, and the wax 130 together, thereby forming the toner 100 for electrostatic use.

Specifically, the agglomeration particle on which a coating layer is formed is heated at a higher temperature than a glass transition temperature of the amorphous polyester resin 112 for a predetermined time, thereby fusing primary particles constituting the agglomeration particle and the coating layer with each other to obtain a particle of the toner 100 for electrostatic use.

A heating condition (for example, a heating temperature condition, a heating atmosphere condition, and a heating time condition) of the fusion process may be appropriately determined considering properties of the toner 100 for electrostatic use.

After the fusion process, the toner 100 for electrostatic use is separated from the solution through a post process such as filtering. That is, the toner 100 for electrostatic use may be manufactured through the series of processes described above.

The method of manufacturing the toner 100 for electrostatic use described above is merely an example, and a method of manufacturing the toner 100 for electrostatic use is not limited to the manufacturing method described above.

Hereinafter, the processes described above are explained in more detail with reference to specific examples. However, these examples are not in any sense to be interpreted as limiting the scope of the disclosure and the claims.

(Synthesizing Amorphous Polyester Resin)

A reflux condenser, a water separation device, a nitrogen gas introducing tube, a thermometer, and a stirring device were mounted in a 500 mL separable flask, and 101.1 g of Adeka Corp. polyether BPX-11 (2 mol of a bisphenol A propylene oxide addition product, manufactured by Adeka Corp., 316 mg KOH/g of a hydroxy group), 107.9 g of Newpol BPE-20 (2 mol of a bisphenol A ethylene oxide addition product, manufactured by Sanyo Chemical Industries, Ltd., 346 mg KOH/g of a hydroxy group), 5.4 g of maleic anhydride, 72.1 g of phthalic anhydride, 2.3 g of PTSA (paratoluene sulfonic 1 hydrate, manufactured by Wako Pure Chemical Industries Ltd.) were added to the separable flask and heated and dissolved at 70° C. while introducing nitrogen into the separable flask.

After confirming that the mixture had dissolved in the separable flask, the inside of the flask was heated to 110° C., and the dehydration condensation was performed for 35 hours under a vacuum (less than or equal to 1 kPa) at 110° C. to synthesize a polyester resin.

Next, the inside of the flask was returned to a normal pressure, and 4.0 g of pyromellitic anhydride and 30 g of toluene (Wako Pure Chemical Industries Ltd.) were added to the mixture and reacted for 4 hours under a nitrogen atmosphere at 105° C.

Subsequently, 7.3 g of diphenylmethane diisocyanate (MDI, manufactured by Wako Pure Chemical Industries Ltd.) and 40 g of methyl ethyl ketone (Wako Pure Chemical Industries Ltd.) was added to the flask, and a urethane modification was performed under a nitrogen atmosphere at 78° C.

The urethane modification was continued until a peak around 2275 $cm^{-1}$ produced by an unreacted isocyanate compound in an infrared spectrophotometer was not detected.

Next, to remove the toluene and the methyl ethyl ketone, the synthesized urethane modified polyester resin was vacuum dried at 60° C. for 24 hours to obtain an amorphous polyester resin (P1).

The properties of the obtained amorphous polyester resin (P1) were as follows: a number average molecular weight (Mn) was 2710, a weight average molecular weight (Mw) was 13300, and Mw/Mn was 4.91. Furthermore, the amount ratio of a polymer resin having a weight average molecular weight of less than or equal to 1000 was 5.1%; a glass transition temperature (Tg) was 61° C.; and an acid value was 12.5 mg KOH/g.

(Supporting Colorant)

1-(methylamino)anthraquinone (1 equivalent) and sodium hydride (NaH, 1 equivalent) were added to a container such as a beaker and stirred at room temperature for 30 minutes and then dissolved in tetrahydrofuran (THF). The dissolved THF solution was dripped into copper acetate (II) 1 hydrate (1 equivalent) and stirred at room temperature for 3 hours to obtain a precursor complex of a colorant and a metal ion. Then the obtained precursor complex was added to the methyl ethyl ketone solution of amorphous polyester resin (P1) and stirred at 70° C. for 3 hours, and the solvent was removed to obtain an amorphous polyester resin (M1) supporting a colorant through a metal ion.

(Forming Amorphous Polyester Resin Latex)

300 g of the amorphous polyester resin (M1), 250 g of methyl ethyl ketone (MEK), and 50 g of isopropyl alcohol (IPA) were added to a 3 L dual jacket reactor and stirred at about 30° C. using a half-moon type impeller to dissolve the amorphous polyester resin (M1).

Then 20 g of 5% aqueous ammonia solution was slowly added to the reactor while stirring the obtained resin solution, and 1200 g of water was added to the reactor at a rate of 20 g/min while the stirring was continued to obtain a latex (emulsion). Then, a solvent was removed from the emulsion by a reduced pressure distillation to obtain an amorphous polyester resin latex (L1) having a solid concentration of 20%.

(Synthesizing Crystalline Polyester Resin)

198.8 g of 1,9-nonanediol (Wako Pure Chemical Industries Ltd.), 250.8 g of dodecane 2 acid (Wako Pure Chemical Industries Ltd.), 0.45 g of paratoluene sulfonic 1 hydrate (PTSA, Wako Pure Chemical Industries Ltd.) were added to a 500 mL separable flask. Then the contents of the flask were stirred by an agitator while nitrogen was introduced into the separable flask while the 1,9-nonanediol, the dodecane 2 acid, and the paratoluene sulfonic 1 hydrate were heated and dissolved at 80° C.

After confirming that the mixture had dissolved in the separable flask, the inside of the flask was heated to 97° C., and the dehydration condensation was performed at 97° C. under a vacuum (less than or equal to 1 kPa) for 5 hours to synthesize a crystalline polyester resin (C1). The properties of the obtained crystalline polyester resin (C1) were as follows: a weight average molecular weight (Mw) was 6000 and an amount ratio of a polyester resin having a weight average molecular weight of less than or equal to 1000 was 7.2%. Furthermore, a melting point (an endothermic peak temperature) of the crystalline polyester resin (C1) measured by a differential scanning calorimeter (DSC) was 70.1° C., a difference between an endothermic initiating temperature and the endothermic peak temperature during a temperature rise in a differential scanning calorimetry curve was 4.3° C., and a heat absorption at melting was 3.4 W/g. In addition, an acid value of the crystalline polyester resin (C1) was 9.20 mg KOH/g, and a sulfur amount was 186.62 ppm in an atomic concentration.

(Forming Crystalline Polyester Resin Latex)

300 g of the crystalline polyester resin (C1), 250 g of methyl ethyl ketone (MEK), and 50 g of isopropyl alcohol (IPA) were added to a 3 L dual jacket reactor and stirred at about 30° C. using a half-moon type impeller to dissolve the crystalline polyester resin (C1).

Then 25 g of 5% aqueous ammonia solution was slowly added to the reactor while stirring the obtained resin solution, and 1200 g of water was added to the reactor at a rate of 20 g/min while the stirring was continued to obtain a latex (emulsion). Then, a solvent was removed from the emulsion by a reduced pressure distillation to obtain a crystalline polyester resin latex (D1) having a solid concentration of 20%.

(Preparing Wax Dispersion Liquid)

270 g of wax (HNP-9, Nippon Seiro Co., Ltd.) having an average carbon number of 37 and a melting point (Tm) of 76° C., 2.7 g of an anionic surfactant (Dowfax 2A1, Dow Chemical Co.), and 400 g of ion exchanged water were mixed. The mixture was heated at 110° C., and then dispersed using a homogenizer (Ultra-Turrax T50, IKA), and further dispersed for 360 minutes using a high pressure homogenizer (NanoVater NVL-ES008, Yoshida Machinery Co., Ltd.) to obtain a wax dispersion liquid having a solid concentration of 20%.

(Preparing Toner)

600 g of the amorphous polyester resin latex (L1), 100 g of the crystalline polyester resin latex (D1), and 560 g of deionized water were added to a 3 L reaction vessel and stirred at 350 rpm. Then 80 g of the wax dispersion liquid, 30 g (0.3 mol) of nitric acid having a concentration of 0.3 N, and 25 g of an agglomerating agent of polysilicate iron (PSI-100, Suido Kiko Kaisha, Ltd.) were added to the reaction vessel.

Then the mixed solution was heated to 50° C. at a rate of 1° C./min while stirring the inside of the reaction vessel using a homogenizer (Ultra-Turrax, T50, IKA). In addition, the agglomeration reaction was continued while the temperature of the reaction solution was increased at a rate of 0.03° C./min to obtain an agglomeration particle having a volume average particle diameter of 4 μm to 5 μm.

Then 300 g of the amorphous polyester resin (P1) was added thereto while stirring the inside of the reaction vessel, and the agglomeration particle and the added amorphous polyester resin (P1) were agglomerated for 30 minutes to form a coating layer on the surface of the agglomeration particle. Then a sodium hydroxide aqueous solution having a concentration of 0.1 N was added to the reaction vessel to adjust the pH of the mixed solution to within a range of 7 to 9. After waiting 20 minutes, the mixed solution in the reaction vessel was heated to 80° C. to 90° C. for 3 hours to 5 hours to melt each of primary particles of the agglomeration particle. As the result, a toner particle having a volume average particle diameter of 5 μm to 7 μm was obtained.

Subsequently, the inside of the reaction vessel was cooled to less than or equal to 28° C. and filtered to recover the obtained toner particle. The recovered toner particle was dried at 40° C. for 24 hours to obtain a toner for electrostatic use according to Example 1. The obtained toner for electrostatic use had a volume average particle diameter of 5.7 μm.

Furthermore, toners for electrostatic use according to Examples 2 to 5 was prepared in accordance with the same procedures as in Example 1, except changing the process conditions as follows:

In Example 2, a toner for electrostatic use was prepared in accordance with the same procedure as in Example 1, except for using nickel acetate (II) 4 hydrate instead of copper acetate (II) 1 hydrate when supporting a colorant.

In Example 3, a toner for electrostatic use was prepared in accordance with the same procedure as in Example 1, except for using zinc acetate (II) 2 hydrate instead of copper acetate (II) 1 hydrate when supporting a colorant.

In Example 4, a toner for electrostatic use was prepared in accordance with the same procedure as in Example 1, except for using 2 equivalents of 1-(methylamino)anthraquinone and using anhydrous iron acetate (II) instead of copper acetate (II) 1 hydrate when supporting a colorant.

A toner for electrostatic use according to Example 5 was prepared in accordance with the same procedure as in Example 1, except for using 2 equivalents of 1-(methylamino)anthraquinone and using cobalt acetate (II) 4 hydrate instead of copper acetate (II)1 hydrate when supporting a colorant.

Furthermore, a toner for electrostatic use according to a Comparative Example 1 was prepared according to the following method.

A reflux condenser, a water separation device, a nitrogen gas introducing tube, a thermometer, and a stirring device were mounted in a 500 mL separable flask, and 101.1 g of Adeka Corp. polyether BPX-11 (2 mol of a bisphenol A propylene oxide addition product, manufactured by Adeka Corp., 316 mg KOH/g of a hydroxy group), 107.9 g of Newpol BPE-20 (2 mol of a bisphenol A ethylene oxide addition product, manufactured by Sanyo Chemical Industries, Ltd., 346 mg KOH/g of a hydroxy group), 5.4 g of maleic anhydride, 72.1 g of phthalic anhydride, 2.3 g of PTSA (paratoluene sulfonic 1 hydrate, manufactured by Wako Pure Chemical Industries Ltd.) were added to the separable flask and heated and dissolved at 70° C. while introducing nitrogen into the separable flask.

After confirming that the mixture had dissolved in the separable flask, the inside of the flask was heated to 110° C., and the dehydration condensation was performed for 35 hours under a vacuum (less than or equal to 1 kPa) at 110° C. to synthesize a polyester resin.

Then the pressure inside the flask was returned to a normal pressure, and 4.0 g of pyromellitic anhydride and 30 g of toluene (Wako Pure Chemical Industries Ltd.) were added to the mixture and reacted for 4 hours under a nitrogen atmosphere at 105° C.

Subsequently, 7.3 g of diphenylmethane diisocyanate (MDI, manufactured by Wako Pure Chemical Industries Ltd.) and 40 g of methyl ethyl ketone (Wako Pure Chemical Industries Ltd.) was added to the mixture, and a urethane modification was performed under a nitrogen atmosphere at 78° C.

The urethane modification was continued until a peak around 2275 $cm^{-1}$ produced by an unreacted isocyanate compound in an infrared spectrophotometer was not detected.

Then, to remove toluene and methyl ethyl ketone, the synthesized urethane modified polyester resin was vacuum dried at 60° C. for 24 hours to obtain an amorphous polyester resin (P1).

The properties of the obtained amorphous polyester resin (P1) were as follows: a number average molecular weight (Mn) was 2710, a weight average molecular weight (Mw) was 13300, and Mw/Mn was 4.91. Furthermore, the amount ratio of polymer resin having a weight average molecular weight of less than or equal to 1000 was 5.1%; a glass transition temperature (Tg) was 61° C.; and an acid value was 12.5 mg KOH/g.

Then 300 g of the amorphous polyester resin (P1), 250 g of methyl ethyl ketone (MEK), and 50 g of isopropyl alcohol (IPA) were added to a 3 L dual jacket reactor and stirred at about 30° C. using a half-moon type impeller to dissolve the amorphous polyester resin (P1).

Then 20 g of 5% aqueous ammonia solution was slowly added to the reactor while stirring the obtained resin solution, and 1200 g of water was added to the reactor at a rate of 20 g/min while the stirring was continued to obtain a latex (emulsion). Then, a solvent was removed from the emulsion by a vacuum distillation to obtain an amorphous polyester resin latex (L6) having a solid concentration of 20%.

As a colorant, magenta pigments of C.I. (Color Index) pigment red 122 and C.I. pigment red 269 were used to obtain a colorant dispersion liquid. Specifically, first, 22.5 g of C.I. pigment red 122, 22.5 g of C.I. pigment red 269, an ionic surfactant of 5 g of Neogen RK (Dai-ichi Kogyo Seiyaku Co., Ltd.), and 200 g of ion exchanged water were mixed and dissolved. Then the mixed solution was dispersed for 10 minutes using a homogenizer (Ultra-Turrax T50, IKA) to obtain a colorant dispersion liquid having a central particle diameter of 168 nm and a solid concentration of 23%.

In Comparative Example 1, a toner for electrostatic use was prepared in accordance with the same procedure as in Example 1, except that 600 g of the amorphous polyester resin latex (L6), 100 g of the crystalline polyester resin latex (D1), 560 g of deionized water, 80 g of the wax dispersion liquid, and 90 g of the colorant dispersion liquid were used.

In Comparative Example 2, a toner for electrostatic use was prepared in accordance with the same procedure as in Comparative Example 1, except that a 1-(methylamino) anthraquinone solution was used instead of a magenta pigment dispersion liquid of C.I. pigment red 122 and C.I. pigment red 269.

In Comparative Example 3, a toner for electrostatic use is prepared in accordance with the same procedure as in Example 1, except that the amounts of 1-(methylamino) anthraquinone and copper acetate(II) 1 hydrate were increased by two times when supporting the colorant.

In Comparative Example 4, a toner for electrostatic use is prepared in accordance with the same procedure as in Example 1, except that the amounts of 1-(methylamino) anthraquinone and copper acetate(II) 1 hydrate were decreased by half (½) when supporting the colorant.

(Evaluation Method of Toner and Results)

Each toner for electrostatic use according to Examples 1 to 5 and Comparative Examples 1 to 4 was evaluated for concentration and toner performance.

Specifically, a concentration of a colorant in the toner for electrostatic use was obtained by extracting a soluble component of the magenta toner using an organic solvent; measuring an absorption spectrum of the extracted soluble component of the magenta toner using a spectrophotometer (UV-2550, Shimadzu Corporation); and calculating a concentration of the extracted soluble component of the magenta toner from the absorption spectrum using a molar extinction coefficient of the extracted soluble component of the magenta toner.

The amount of each of the components in the toner for electrostatic use was calculated using an Energy Dispersive X-ray (EDX) Fluorescence Spectrometer (EDX-720, Shimadzu Corporation). More specifically, a quantitative analysis for each toner for electrostatic use was performed with an X-ray tube voltage of 50 kV in a X-ray fluorescence analysis and 30.01 g of a sample amount of the toner for electrostatic use to calculate amounts of iron, silicon, sulfur, and fluorine included in each toner for electrostatic use. In addition, the amounts of metal ions included in each toner for electrostatic use were calculated in accordance with the same procedure.

A ratio of the urethane group in the toner for electrostatic use was calculated as follows: Specifically, first 2 g of each magenta toner was dissolved in tetrahydrofuran (THF), and the dissolved THF solution was dripped in 200 mL of a methanol solution of potassium hydroxide (0.1 mol/L) and allowed to stand at 50° C. for 24 hours. Then the solvent was removed, and the residue was washed by ionic exchanged water until pH was approximately 7, and the remaining solid was dried. After the drying, the sample was added to a mixed solvent (volume ratio 9:1) of dimethylacetamide (DMAc) and deuterated dimethyl sulfoxide (DMSO-d6) until a sample concentration of 100 mg/0.5 mL was reached, and then the sample was dissolved at 70° C. for 24 hours. After the dissolving, a C13-NMR spectrum of the solution was measured at 50° C. using a nuclear magnetic resonance spectrometer (Avance-300, manufactured by Bruker Corporation). From the peak area of the urethane bond peak present at 154.36 ppm, a urethane bond ratio in the toner for electrostatic use was calculated.

A particle diameter of the toner for electrostatic use was measured using a precision particle size distribution meter (Multisizer 3 Coulter Counter particle analyzer, Beckman-Coulter). Specifically, the toner was dispersed into an electrolyte solution (Isoton II) from a 100 μm gap tube, and the particle size distribution of the toner was measured at a measurement number of 30000. From the measured particle size distribution of the toner, the cumulative distribution of the volume and number of each toner was measured to obtain the volume average particle diameter (D50v).

A glass transition temperature (Tg) of the toner for electrostatic use was measured using a differential scanning calorimeter (DSC) (Q2000, TA Instruments). First, in a first temperature increasing process, the temperature was increased from room temperature to 150° C. at a rate of 10° C./min and maintained at 150° C. for 5 minutes, and then cooled to 0° C. at a rate of 10° C./min using liquid nitrogen. Then the temperature was maintained at 0° C. for 5 minutes, and in a second temperature increasing process, the temperature was increased from 0° C. to 150° C. at a rate of 10° C./min. Using a differential scanning calorimetry curve obtained from the temperature control, a glass transition temperature of the toner for electrostatic use was calculated. Temperature correction of the differential scanning calorimeter (DSC) was performed based on melting points of indium and zinc, and calorific correction was performed based on a heat of fusion of indium. The sample was placed on an aluminum pan, and an empty aluminum pan was used as a control sample.

The coloring evaluation of the toner for electrostatic use was performed using a SpectroEye spectrophotometer (Sakata INX Engineering Co., Ltd.) using a D50 light source and using ISO T as a concentration reference. An observation field of view was set at 2°.

The light transmittance of the toner for electrostatic use was obtained by projecting a front-side image on which the toner for electrostatic use was output in a solid color to an overhead projector, and measuring the projected light using a spectrophotometer (UV-2550, Shimadzu Corporation). The light transmittance of the toner for electrostatic use is a spectral transmittance for light within a 650 nm wavelength band, which was calculated by measuring a visible spectral transmittance of the projected light of the overhead projector using the spectrophotometer.

Charging characteristics of the toner for electrostatic use were evaluated as follows: 28.5 g of a magnetic carrier (SY129, KDK) and 1.5 g of the toner for electrostatic use were added to a 600 ml glass vessel and stirred using a Turbula mixer, and then an electrolytic separation was performed. The charging characteristics of the toner for electrostatic use were evaluated under conditions of room temperature and normal humidity (23° C., RH 55%), high temperature and high humidity (32° C., RH 80%), and low temperature and low humidity (10° C., RH 10%). The evaluation standards of the toner for electrostatic use were as follows, and with the charging characteristics getting better going from C to A.

A: a saturation curve related to a stirring time is smooth, and a variation range of a charge-to-mass ratio after the saturated charge is insignificant B: a saturation curve related to a stirring time is sharply increased, or a charge-to-mass ratio after the saturated charge is changed (a change of less than or equal to 30%)

C: a charge is not saturated by a stirring time, or a charge-to-mass ratio after the saturated charge is significantly changed (a change of more than or equal to 30%)

The fixing property of the toner for electrostatic use was evaluated by printing a test image using a belt-type fixer (fixer for color laser printer model CLP-660, Samsung Electronics Co., Ltd) under the following conditions:

Test image: 100% solid pattern

Test temperature: 100° C. to 180° C. (at 10° C. intervals)

Test paper: 60 g paper (X-9, Boise)

Fixing speed: 160 mm/sec

Fixing time: 0.08 sec

An 810 tape (3M) was attached to the image region of the fixed image, a 500 g weight was rolled over the tape 5 times, and then the tape was removed. A fixing value was determined as a ratio of an optical density (OD) after removing the tape to an optical density (OD) before attaching the tape expressed as a percentage. The fixing value was calculated at each of the test temperatures, and the temperature region in which the fixing value was greater than or equal to 90% was estimated as a fixing region.

A MFT (Minimum Fusing Temperature) was determined to be a lowest temperature at which the fixing value without a cold offset was greater than or equal to 90%. The lower the MFT, the better the fixing property of the toner for electrostatic use.

The high temperature preservation of the toner for electrostatic use was evaluated by storing the toner under the condition of high temperature and high humidity. Specifically, the toner for electrostatic use was added to a mixer (KM-LS2K, DAE WHA Tech Co., Ltd.), and 0.5 g of NX-90 (Nippon Paint aerosol), 1.0 g of RX-200 (Nippon Paint aerosol), and 0.5 g of SW-100 (Titan Kogyo, Ltd.) were added thereto and stirred at 8000 rpm for 4 minutes to add an external additive into the toner for electrostatic use. Subsequently, the toner was put into a developer (developer for color laser printer model CLP-660, Samsung Electronic Co., Ltd.), and stored in a thermo-hygrostat oven in a packaged state. The storing conditions were as follows: 2 hours at 23° C./RH 55%, then 48 hours at 40° C./RH 90%, 48 hours at 50° C./RH 80%, 48 hours at 40° C./RH 90%, and 6 hours at 23° C./RH 55%.

After the storing, the toner for electrostatic use was checked to see if it was caked or not in the developer, and the toner for electrostatic use was printed in a 100% solid pattern to check if the image was inferior. The evaluation standards were as follows, with high temperature preservation getting better going from C to A.

A: image good, no caking

B: image inferior, no caking

C: caking

The durable printability of the toner for electrostatic use was evaluated by continuously printing 1000 sheets of a solid colored image.

Specifically, a commercially available printer cartridge (LP-1400, Epson) was charged with the toner for electrostatic use, and 1000 sheets of a solid colored image were continuously printed. The durable printability of the toner for electrostatic use was evaluated by monitoring the image after printing the 1000 sheets by the naked eye. The evaluation standards were as follows, with the durable printability getting better going from C to A.

A: no stripes or stains

B: a few stripes or stains (3 or less)

C: many stripes or stains (more than 3)

The light resistance of the toner for electrostatic use was evaluated by measuring a color difference (ΔE) before and after continuously irradiating the toner with ultraviolet light. Specifically, ultraviolet (UV) light was continuously irradiated for 96 hours onto a solid-colored image in which the toner for electrostatic use was printed as a solid color, and a color difference (ΔE) before and after the ultraviolet irradiation was evaluated using a SpectroEye spectrophotometer (Sakata INX Engineering Co., Ltd.). The measurement atmosphere was at room temperature and a normal humidity condition (23° C., RH 55%). The evaluation standards were as follows, with the light resistance getter better going from D to A. A toner for electrostatic use having a level of B or greater can be used without any problems.

A: $\Delta E<1.0$

B: $1.0\leq\Delta E<2.0$

C: $2.0\leq\Delta E<5.0$

D: $\Delta E\geq5.0$

FIG. 2 is a table showing evaluation results of the toners for electrostatic use according to Examples 1 to 5 and Comparative Examples 1 to 4.

Referring to FIG. 2, it can be confirmed that the toners for electrostatic use according to Examples 1 to 5 all have a high light transmittance, excellent charge properties, a high temperature preservation, a durable printability, and a high light resistance.

On the other hand, it can be confirmed that since Comparative Example 1 includes a pigment having a low light transmittance as a colorant, the charge properties, the high temperature preservation, the durable printability, and the light resistance are good, but the light transmittance is deteriorated. Accordingly, the toner for electrostatic use according to Comparative Example 1 limits the color reproducible region as described above.

In addition, since an organic dye having a high light transmittance is used as a colorant in Comparative Examples 2 to 4, the light transmittance is high, but at least one of the charge properties, the high temperature preservation, the durable printability, and the light resistance is deteriorated.

While this disclosure includes specific examples, it will be apparent after an understanding of the disclosure of this application that various changes in form and details may be made in these examples without departing from the spirit and scope of the claims and their equivalents. The examples described herein are to be considered in a descriptive sense only, and not for purposes of limitation. Descriptions of features or aspects in each example are to be considered as being applicable to similar features or aspects in other examples. Suitable results may be achieved if the described techniques are performed in a different order, and/or if components in a described system, architecture, device, or circuit are combined in a different manner, and/or replaced or supplemented by other components or their equivalents. Therefore, the scope of the disclosure is defined not by the detailed description, but by the claims and their equivalents, and all variations within the scope of the claims and their equivalents are to be construed as being included in the disclosure.

What is claimed is:

1. A toner for electrostatic use comprising a binder resin comprising an amorphous polyester resin having a urethane bond and a crystalline polyester resin;

a metal ion forming a chemical bond with the binder resin;

at least one colorant forming a coordinate bond with the metal ion and being supported on the binder resin through the metal ion; and at least three elements selected from an iron element, a silicon element, a sulfur element, and a fluorine element while including at least one of an iron element, a silicon element, and a sulfur element;

wherein an amount of the iron element is about 1000 ppm to about 10000 ppm as an element concentration;

an amount of the silicon element is about 1000 ppm to about 5000 ppm as an element concentration; and an amount of the sulfur element is about 500 ppm to about 3000 ppm as an element concentration.

2. The toner for electrostatic use of claim 1, wherein the at least three elements comprise a fluorine element; and an amount of the fluorine element is about 1000 ppm to about 10000 ppm as an element concentration.

3. The toner for electrostatic use of claim 1, wherein the metal ion is an ion of a metal selected from magnesium, aluminum, iron, cobalt, nickel, copper, and zinc.

4. The toner for electrostatic use of claim 1, wherein the colorant comprises a compound having a maximum absorption wavelength in a wavelength range of about 500 nm to about 600 nm and represented by the following Chemical Formula 1:

(Chemical Formula 1)

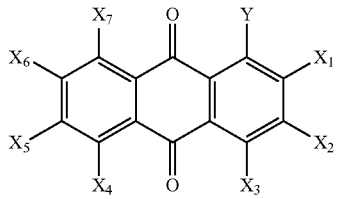

wherein, in Chemical Formula 1,

Y is one of a hydroxy group, a primary amino group represented by $NHR_1$, and a secondary amino group represented by $NHR_1R_2$, $R_1$ and $R_2$ are independently a C1 to C20 linear group, a C1 to C20 branched alkyl group, or a C6 to C20 aryl group, and $X_1$ to $X_7$ are independently hydrogen, a halogen, an amino group, a nitro group, a hydroxy group, an alkoxy group, a C1 to C20 linear group, a C1 to C20 branched alkyl group, or a C6 to C20 aryl group; and the compound represented by the Chemical Formula 1 comprises either one or both of a nitrogen atom and an oxygen atom of the Chemical Formula 1 that forms a coordinate bond with the metal ion.

5. The toner for electrostatic use of claim 4, wherein the compound represented by the Chemical Formula 1 is an organic dye; and a light transmittance of the toner for electrostatic use at a wavelength of 650 nm is about 70% to about 100%.

6. The toner for electrostatic use of claim 1, wherein the metal ion forms a coordinate bond with the urethane bond of the amorphous polyester resin.

7. The toner for electrostatic use of claim 6, wherein a ratio of the urethane bond forming a coordinate bond with the metal ion is about 80% to about 100%.

8. The toner for electrostatic use of claim 1, wherein the metal ion forms a coordinate bond with the urethane bond of the amorphous polyester resin in a ratio of about 1:1 to about 1:2.

9. The toner for electrostatic use of claim 1, wherein the metal ion forms a coordinate bond with the at least one colorant in a ratio of about 1:1 to about 1:2.

10. The toner for electrostatic use of claim 1, wherein a ratio of the urethane bond is about 0.5 mass % to about 2.0 mass % based on a total mass of the toner for electrostatic use.

11. The toner for electrostatic use of claim 1, wherein an amount of the metal ion is about 0.7 mass % to about 2.5 mass % based on a total mass of the toner for electrostatic use.

12. A toner for electrostatic use comprising:

a binder resin comprising an amorphous polyester resin having a urethane bond and a crystalline polyester resin;

a metal ion forming a chemical bond with the binder resin; and a colorant forming a chelate bond with the metal ion and being supported on the binder resin through the metal ion.

13. The toner for electrostatic use of claim 12, wherein the chelate bond comprises two or more coordinate bonds.

14. The toner for electrostatic use of claim 12, wherein the colorant comprises a compound comprising:

a carbonyl group comprising an oxygen atom; and a functional group comprising one or more oxygen atoms, or one or more nitrogen atoms, or one or more oxygen atoms and one or more nitrogen atoms;

wherein the colorant forms the chelate bond with at least two atoms selected from the oxygen atom of the carbonyl group, the one or more oxygen atoms, if any, of the functional group, and the one or more nitrogen atoms, if any, of the functional group.

15. The toner for electrostatic use of claim 14, wherein the compound is represented by the following Chemical Formula 1:

(Chemical Formula 1)

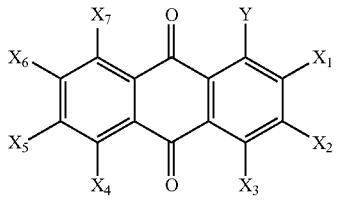

wherein, in Chemical Formula 1,

O is the oxygen atom of the carbonyl group,

Y is the functional group and is one of a hydroxy group, a primary amino group represented by $NHR_1$, and a secondary amino group represented by $NHR_1R_2$, $R_1$ and $R_2$ are independently a C1 to C20 linear group, a C1 to C20 branched alkyl group, or a C6 to C20 aryl group, and $X_1$ to $X_7$ are independently hydrogen, a halogen, an amino group, a nitro group, a hydroxy group, an alkoxy group, a C1 to C20 linear group, a C1 to C20 branched alkyl group, or a C6 to C20 aryl group.

16. The toner for electrostatic use of claim 14, wherein the compound represented by the Chemical Formula 1 has a maximum absorption wavelength in a wavelength range of about 500 nm to about 600 nm.

17. The toner for electrostatic use of claim 14, wherein the compound represented by the Chemical Formula 1 is an organic dye.

18. The toner for electrostatic use of claim 12, a light transmittance of the toner for electrostatic use at a wavelength of 650 nm is about 70% to about 100%.

19. The toner for electrostatic use of claim 12, further comprising at least three elements selected from an iron element, a silicon element, a sulfur element, and a fluorine element while including at least one of an iron element, a silicon element, and a sulfur element;

wherein an amount of the iron element is about 1000 ppm to about 10000 ppm as an element concentration;

an amount of the silicon element is about 1000 ppm to about 5000 ppm as an element concentration; and an amount of the sulfur element is about 500 ppm to about 3000 ppm as an element concentration.

20. The toner for electrostatic use of claim 19, wherein the at least three elements comprise a fluorine element; and an amount of the fluorine element is about 1000 ppm to about 10000 ppm as an element concentration.

* * * * *